US006223853B1

(12) United States Patent
Huon et al.

(10) Patent No.: US 6,223,853 B1
(45) **Date of Patent: *May 1, 2001**

(54) LOUDSPEAKER SYSTEM INCORPORATING ACOUSTIC WAVEGUIDE FILTERS AND METHOD OF CONSTRUCTION

(76) Inventors: Graeme John Huon, 39 Monomeith Crescent, Mt. Waverley, Victoria (AU), 3149; Gregory Keith Cambrell, 62 Lohr Avenue, Inverloch, Victoria (AU), 3996; Walter Melville Dower, 19 Summerlea Road, Mt. Dandenong, Victoria (AU), 3767

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/574,477

(22) Filed: Dec. 19, 1995

(30) Foreign Application Priority Data

Dec. 23, 1994 (AU) ..... PN 0290
Mar. 1, 1995 (AU) ..... PN 1456

(51) Int. Cl.[7] ..... G10K 13/00; H04R 7/00

(52) U.S. Cl. ..... 181/145; 181/148; 181/155; 181/160; 181/199

(58) Field of Search ..... 181/148, 145, 181/156, 155, 160, 199

(56) References Cited

U.S. PATENT DOCUMENTS

| | | | | |
|---|---|---|---|---|
| 1,869,178 | | 7/1932 | Thuras | 181/160 |
| 1,969,704 | | 8/1934 | D'Alton | 181/160 |
| 2,689,016 | | 9/1954 | Lang | 181/145 |
| 3,327,808 | * | 6/1967 | Shaper | 181/156 |
| 4,064,966 | | 12/1977 | Burton | 181/144 |
| 4,210,778 | * | 7/1980 | Sakurai et al. | 181/156 |
| 4,549,631 | | 10/1985 | Bose | 181/155 |
| 4,875,546 | | 10/1989 | Krnan | 181/160 |
| 4,932,060 | * | 6/1990 | Schreiber | 181/145 |
| 5,025,885 | * | 6/1991 | Froeschle | 181/156 |
| 5,092,424 | | 3/1992 | Schreiber et al. | 181/145 |
| 5,147,986 | * | 9/1992 | Cockrum et al. | 181/145 |
| 5,150,417 | | 9/1992 | Stahl | 181/154 |
| 5,197,103 | | 3/1993 | Hayakawa | 181/159 |
| 5,253,301 | * | 10/1993 | Sakamoto et al. | 181/145 |
| 5,313,525 | | 5/1994 | Klasco | 181/156 |
| 5,513,270 | * | 4/1996 | Lewis | 181/160 |

FOREIGN PATENT DOCUMENTS

| | | |
|---|---|---|
| 0 332 053 | 9/1989 | (EP) . |
| 0 456 416 | 11/1991 | (EP) . |

OTHER PUBLICATIONS

D. Berriman, "The Bass Race", Electronics World & Wireless World, Feb. 1994 (UK), pp. 117–122.

I. Gosling, "Extending Bass", Electronics World & Wireless World, Feb. 1994 (UK), pp. 100–105.

H. Mayr "Theory of Vented Loudspeaker Enclosures", Alta Frequenza, vol. 53, No. 2, Mar.–Apr. 1984 (Italy), pp. 91–99.

* cited by examiner

*Primary Examiner*—David M. Gray
(74) *Attorney, Agent, or Firm*—McDermott, Will & Emery

(57) ABSTRACT

A method of constructing an acoustic filter incorporates a technique in which the filter is modelled with one or more distributed two port elements. The or each distributed element is defined by a characteristic impedance and length and includes a waveguide filter which does not require damping. The or each filter section is characterized in that it has at least two resonances which are used to shape a specified response for the filter. A substantially reactive acoustic filter constructed according to the method and a loudspeaker system incorporating such an acoustic filter are also disclosed.

14 Claims, 5 Drawing Sheets

LOUDSPEAKER SYSTEM INCORPORATING ACOUSTIC WAVEGUIDE FILTERS AND METHOD OF CONSTRUCTION

The present invention relates to a loudspeaker system incorporating one or more acoustic filters, in particular waveguide filters, and to a method of construction thereof.

The term waveguide originates from general Electromagnetic wave theory wherein it describes the general form of a bounded region for guided propagation of waves. This general electromagnetic case and the acoustic case considered herein are analogous.

The present invention is restricted to the dominant mode of propagation of sound waves and therefore the filter sections could alternately be referred to as transmission line sections, as the mode of propagation obeys frequency independent phase velocity (analogous to Transverse Electro Magnetic (TEM) modes in waveguides).

However, the term transmission line in audio parlance has become associated with particular enclosure designs wherein heavy loss is introduced for one side of the transducer. The common use of the term transmission line is thus no longer understood to relate to supporting a mode of propagation over the frequency range as is the case with the electromagnetic domain. Hence the term acoustic waveguide is used herein in preference.

There are many applications for acoustic filters and the techniques described herein are relevant to many of them. Accordingly, although the present invention is described herein in relation to and in the context of loudspeaker systems, it is to be appreciated that it is not thereby limited to such applications.

Loudspeaker systems include a combination of one or more electro-acoustic transducers or drivers together with a partial or complete enclosure (referred to herein as an enclosure) and may be categorized by the nature of their frequency response when driven from a constant amplitude sinusoidal voltage source. Closed or sealed enclosures, also known as infinite baffle or acoustic suspension enclosures, provide high pass systems with second order roll off at relatively low frequencies. Vented enclosures, also known as bass reflex or Helmholtz resonator enclosures, provide high pass systems with fourth order roll off. Conventional closed/vented or double vented enclosures provide bandpass systems having an additional second order roll off at relatively high frequencies. Variants of these basic enclosures have been proposed which use additional chambers and/or additional vents between chambers and/or folded ducts exiting internally or externally.

Many attempts have been made over the last seventy years to construct low frequency loudspeaker systems with optimum performance subject to various physical constraints. The most sophisticated prior art loudspeaker designs are based on techniques which utilize lumped component equivalent circuits. All of the categories of enclosures described above can reasonably be modelled with lumped equivalent circuits. However, these models are restricted in usefulness to special cases. One known design disclosed by Schreiber in U.S. Pat. No. 5,092,424 incorporates a multi-chamber enclosure. However, the latter system still only employs one resonance per chamber and has attendant space utilization problems.

A disadvantage of prior art lumped equivalent circuit modelling techniques is that they fail to assist designers to recognize or exploit the benefits of undamped waveguides or waveguide sections in the design of acoustic filters.

An object of the present invention is to provide an improved method of constructing a loudspeaker system. The method of the present invention includes a relatively sophisticated modelling technique which may assist designers to recognize and exploit a more diverse range of acoustic elements including elements having predominantly distributed natures.

A further object of the present invention is to provide an improved loudspeaker system and in one embodiment a loudspeaker system having improved acoustical response for reproducing frequencies at the low end of the audible/infrasonic spectrum.

It has long been understood that selected multiple resonances are a means of improving performance in loudspeakers. The problem has been that the obvious means of providing multiple resonances namely by adding resonators has consequent cost, space and complexity problems and in any case provides only one beneficial resonance per resonator in the pass band, this resonance being the fundamental resonance for that resonator.

The present invention addresses these limitations by utilizing as a filter at least one acoustic waveguide or waveguide section. A waveguide or waveguide section may be arranged to provide a plurality of resonances. Significantly the resonances may be non-fundamental resonances. The resonances also may be substantially undamped i.e. the may not require damping. The present invention also provides a technique for beneficially selecting and methodically placing such resonances to shape the response of the filter. The filter may be adapted to improve flexibility in alignment of response characteristics of a loudspeaker system and/or to enhance performance of the system. The filter may be integrally built into the loudspeaker system or otherwise attached thereto.

Whilst it is not possible to say with absolute certainty that prior art loudspeaker enclosure designs (especially those which were experimentally derived) have not accidentally incorporated a non-fundamental resonance in one of its air paths for a beneficial result, applicant is not aware of any prior art enclosure designs that have consistently incorporated substantially undamped non-fundamental resonances in a methodic way or that have optimally placed a single non-fundamental resonance to maximum benefit. To applicants best knowledge, in no prior art enclosure designs has placement of non-fundamental resonances been a cause of improved performance over conventional methods and no designer has to date deliberately designed non-fundamental resonances into enclosures.

As indicated above a variant of prior art designs has been the addition of folded ducts, sometimes called "transmission lines" or "quarter wave labyrinths". Although the latter terms are borrowed from transmission line theory they are not the result of any generalised modelling technique as is the case in the present invention and do not incorporate the advantages offered by the present invention. On the contrary prior art transmission lines are designed to be deliberately highly absorptive, lossy and of low efficiency. Any non-fundamental resonances which may exist are so heavily damped that labyrinthine ducts are regarded as one of the least resonant enclosures known. In contrast an important feature of the present invention is the use of waveguide filter sections which are substantially reactive, undamped, low loss and therefore high efficiency.

Conventional acoustic horns have also been used as filters as they provide certain advantages over other designs in controlling the behaviour of drivers. Finite acoustic horns represent a monotonically increasing cross section filter, which limits their usefulness for low frequency applications where impractical dimensions are required for effective horn loaded operation. Some instances have achieved limited compaction by the use of folded horn configurations but size is still a limitation. The present invention provides an alternative to conventional horn design with potentially improved and more compact design characteristics by the use of waveguide filter sections.

The present invention provides a new and fundamentally more accurate method for modelling and constructing acoustic filters. The method of the present invention differs from previous modelling methods in that it allows recognition of filter elements that are predominantly distributed in nature and their beneficial incorporation into the design. This may be achieved by treating appropriate components as waveguide filter sections defined by characteristic impedance and length and analysing the components accordingly.

The above approach may provide a suffficiently accurate analysis to allow controlled utilization of non-fundamental resonances in the waveguide filter sections. The approach may also allow partial or complete elimination of damping material in the waveguide filter sections. Partial or complete elimination of damping material is desirable because it facilitates creation of relatively efficiency filter designs. The above approach also inherently creates new degrees of freedom in the modelling/design process.

Utilisation of substantially undamped multi-resonant waveguide sections has advantages in facilitating adjustment of response characteristics and minimising driver cone excursion. The latter has the effect of reducing distortion. The former has the effect of extending the frequency range of the filter.

A loudspeaker system is essentially a combination of one or more acoustic filters and one or more electro-acoustic drivers. The filters and drivers may be designed around an enclosure to produce a specified acoustic output over a defined frequency range when operating into a specified acoustic environment.

This information may indicate a preferred choice for an enclosure configuration including the combination of an open or closed chamber (acoustic waveguide) on one or both sides of one or more electro-acoustic drivers. It may also indicate approximate dimensions.

Like mechanical systems, acoustical systems may be more easily modelled as equivalent electrical analogues to facilitate an optimization process. The equivalent electrical analogues may be obtained by comparing differential equations of motion for both systems. The acoustical and electrical systems are considered analogous if their differential equations of motion are mathematically the same. Corresponding terms in the differential equations of motion are analogous to each other. Equivalent electrical circuits may then be created and analysed using standard circuit analysis techniques.

The next step in the construction of a loudspeaker system according to the present invention is the design of an initial acoustic waveguide with resonance at the lowest desired frequency to be reproduced. This design may create an acoustic filter utilising multiple resonances obtained from each acoustic waveguide section. These resonances may provide a series of minima in the driver diaphragm displacement($x_D$) and in the Enclosure Characteristic Curve of Driver Displacement (ECCDD). For an enclosure having a lumped vented chamber on one side of a driver and a chamber and single acoustic waveguide of length d and characteristic impedance $Z_O$ on the other side of the driver, it may be shown that a series of minima in the driver diaphragm displacement will be produced in accordance with the formula:

$$\frac{x_D}{v_G} = \frac{Bl}{s_D^2 j\omega Z_{EV}} \times \frac{1}{C/F + Z_{AD} + Z_{AF}}$$

where $$C/F = j\omega\left(M_{AB1} + Z_0\tau\frac{\sin kd}{kd}\right)\frac{\left[1 + \left(\cos kd - 1 + (j\omega)^2(C_{AB1} + C_{AB3})Z_0\tau\frac{\sin kd}{kd}\right)\frac{M_{AB1}}{M_{AB1} + Z_0\tau\frac{\sin kd}{kd}}\right]}{[1 + (j\omega/\omega_{B1})^2]\left[\cos kd + (j\omega)^2 C_{AB3}Z_0\tau\frac{\sin kd}{kd}\right]}$$

The or each acoustic filter according to the present invention may include one or more waveguide filter sections. Where a plurality of filter sections are used, these may be arranged in cascade or in parallel or in combinations of cascade and parallel or more complex configurations.

The initial step in the construction of a loudspeaker system according to the present invention is the specification of performance criteria and design objectives. The initial specification for a system may include:

a. frequency range of the pass band with desired tolerance on amplitude and phase response;

b. asymptotic amplitude roll-off slopes above and below the pass band (thereby also specifying asymptotic phase response);

c. maximum design figure for rated acoustic power output into a specified acoustic environment (for example 2π steradians);

d. overall desired maximum physical size for the enclosure;

e. desired distortion performance; and f. desired efficiency.

Note: The various terms used in the formulas herein are set out in the Appendix.

The resultant driver diaphragm displacement will contain a defined extended series of maxima and minima. Those resultant peaks and dips in the displacement (and ECCDD) may not necessarily correspond to peaks or dips in the acoustic output from the enclosure, but may assist in controlling the response.

Each identifiable acoustic waveguide will result in similar behaviour. When acoustic waveguides are combined in cascade or in parallel, each section may produce such behaviour, and the overall combinations of sections may exhibit a multiplicity of resonances.

If, for example, a single acoustic waveguide is subdivided into two waveguides with equal overall length or delay but two differing characteristic impedances, the series of resonances of the original overall section will be modified into two sets of resonances corresponding to the two new sections. The lowest frequency resonances will still be related to the overall length of the two combined waveguides. The resonances so formed will behave in accordance with the values of delay and characteristic impedance attributable to each filter section and combinations thereof in accordance with the above equation. Adding acoustic waveguides by division of the original acoustic waveguide will add sets of multiple resonances.

Since the behaviour of the enclosure at the lowest frequency of the pass band is predominantly governed by the overall dimensions of the acoustic waveguide filters specified in the initial specification, the shape of each chamber may be chosen within the constraint of the overall maximum physical size of the enclosure, to provide the first ECCDD minimum near the lowest frequency of the pass band.

The acoustic waveguide section may be modelled as having the overall length d, which provides a one way propagation delay (τ):

$$\tau = \frac{kd}{\omega} = \frac{1}{c}d,$$

and a nominal characteristic impedance:

$$Z_0 = \rho_0 C^2 \frac{1}{S_t}$$

where $S_t$ can be regarded as the ratio of the volume V of the acoustic waveguide to its overall length, d. The filter may be implemented as two or more acoustic waveguide sections in parallel or as a single set of cascaded acoustic waveguide sections.

The design approach may enable synthesis of the required response by utilising multiple acoustic waveguide sections, by choosing where their resonances are placed and by manipulating their values of delay and characteristic impedance.

Single uniform sections of acoustic waveguide may provide multiple higher order minima of ECCDD. The next step in the construction of a loudspeaker system according to the present invention is to partition the initial acoustic waveguide into waveguide sections, either as cascades or branches or combinations of both, with the intent of:

1. providing maximum benefit from multiple resonances and associated ECCDD minima whilst;
2 enabling tailoring of the resultant response to meet the specifications for amplitude and phase; and
3. preserving the ECCDD minima derived from the initial single or parallel acoustic waveguide section design.

The overall modelling approach may be iterative and based on analytical or numerically simulated solution of an equivalent electrical circuit of the driver/enclosure/external load combination. The topology of the enclosure may be modelled as one or more inter-connected acoustic waveguide sections in conjunction with the electro-acoustic driver(s) and the appropriate resulting air load for the enclosure.

The interconnection of acoustic waveguides of differing characteristic impedances creates a discontinuity at the interface and may require inclusion of circuit simulation elements to represent the discontinuity. Theoretical and experimental studies have shown that for two acoustic waveguides of differing cross-sectional areas ST1 and ST2 at the discontinuity, the lumped acoustic discontinuity masses ($M_A^{disc}$) determined empirically from:

$$M_A^{disc} = 0.26\rho_0\sqrt{\frac{\pi}{S_{T1}}}\left\{1 - 1.4\sqrt{\frac{S_{T1}}{S_{T2}}} + 0.4\frac{S_{T1}}{S_{T2}}\right\} \text{ for } S_{T1} \le S_{T2}.$$

The resulting network can then be analysed by using standard circuit analysis techniques such as node (Kirchhoff Current Law) or loop (Kirchhoff Voltage Law) analysis. However, the circuit analysis technique chosen should be capable of incorporating distributed structures. A computer-based circuit simulation package such as SPICE may be used for this purpose. Each acoustic waveguide section may be simulated as a lossless transmission line section characterised by Zo and τ.

The parameters of the acoustic waveguide filter sections may be varied in an iterative manner from coarsely chosen initial to target values and the resulting effect on the acoustic output and ECCDD across the pass band calculated, until a specified response is obtained.

A closed-form optimisation of the response can also be undertaken but will not be described here.

Once the desired characteristic impedance and one-way propagation delay for each acoustic waveguide section are defined, the acoustic waveguide sections can be given physical dimensions. The area (St) of the acoustic waveguide section is given by:

$$St = (\rho_0 c)/Zo \text{ for each section}$$

Each acoustic waveguide section can then be specified in terms of length (corresponding to time delay) and area.

The construction process may also consider other factors such as practical limitations of electro-acoustic driver construction and peak air particle velocity in each acoustic waveguide section to minimise distortion and noise resulting from air turbulence.

The method of construction according to the present invention addresses the limitations of lumped element models and allows a designer to take advantage of the distributed nature of chambers, ducts, vents and other structures found in acoustic filters and loudspeaker enclosures. In summary the construction method may include the steps of:

1. selection of an enclosure and acoustic filter configuration to suit the desired design criteria;
2. creation of an equivalent circuit model incorporating the equivalent circuit of the driver and all filter elements, including discontinuities;
3. representing the filter elements as waveguide or transmission line sections of desired characteristic impedance and length or lumped components according to design requirements;
4. analysing the model using any suitable analysis technique or computer simulation package for electrical circuits (the analysis will show the frequencies where resonances are located);
5. fine tuning the model to provide the desired results, paying particular attention to beneficial placement of resonances including non-fundamental resonances; and
6. converting the electrical analogy to acoustic components within the size and shape constraints of the design criteria.

Loudspeaker systems covering a wide variety of embodiments may be constructed according to present invention, including embodiments having:

any enclosure design, whether conventional or not, having one or more waveguide acoustic filters built into the system or attached thereto by any suitable means;

any enclosure having waveguide acoustic filters coupled to one or both sides of the speaker driver, or to one or more chambers, vents, ducts, cavities, passive radiators or other sound generating or transmitting structures forming part of the enclosure, or any combinations thereof; and any enclosure having any number of waveguide acoustic filters arranged in any branching combination including cascade and/or parallel configurations.

Preferred embodiments of the present invention will now be described with reference to the accompanying drawings wherein.

Figure 1:
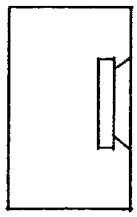
FIG 1 (PRIOR ART)
FIG. 1 shows a cross-sectional view of a prior art sealed enclosure loudspeaker system.
Figure 2:
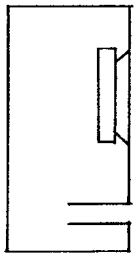
FIG 2 (PRIOR ART)
FIG. 2 shows a cross-sectional view of a prior art vented enclosure loudspeaker system.
Figure 3:
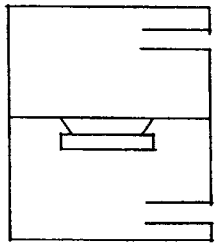
FIG 3 (PRIOR ART)
FIG. 3 shows a cross-sectional view of a prior art double-vented enclosure loudspeaker system.
Figure 4:
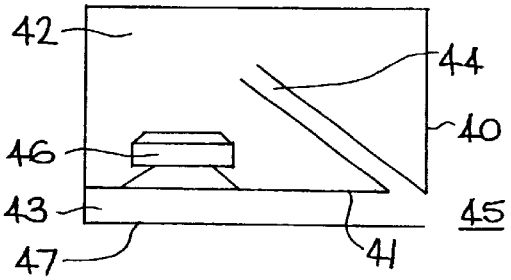
FIG. 4 shows a cross-sectional view of a loudspeaker system according to one embodiment of the present invention.

Referring to the drawings, FIGS. 1, 2 and 3 show prior art sealed, vented and double vented enclosures, respectively described at pages 1 and 2, FIG. 4 shows in cross section a loudspeaker system according to one embodiment of the present invention. The system of FIG. 4 includes a single waveguide filter section attached to a vented enclosure 40. Enclosure 40 includes a baffle 41 dividing enclosure 40 into an interior chamber 42 and at least one duct 43 which provides an acoustic waveguide filter section. Interior chamber 42 is vented to the exterior of enclosure 40 by at least vent 44 which terminates into exterior space 45 by way of duct 43. At least one electro-acoustic driver 46 is mounted on baffle 41. Chamber 42, duct 43 and vent 44 may be realized with various aspect ratios and by use of cleating, folding andlor baffling techniques. One wall of enclosure 40 such as base wall 47 of duct 43 may be formed by placing the enclosure on a flat surface such as a floor.

Figure 5:
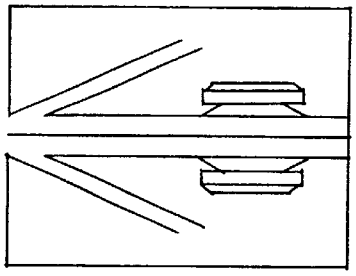
FIG. 5 shows a cross-sectional view of a loudspeaker system according to another embodiment of the present invention.

FIG. 5 shows a loudspeaker system according to another embodiment of the present invention being a pair of systems as in FIG. 4 facing each other. The design and operation of the latter embodiment is substantially identical to that described with reference to the embodiment of FIG. 4, except that the air load is shared between the two systems resulting in greater output.

Figure 6:
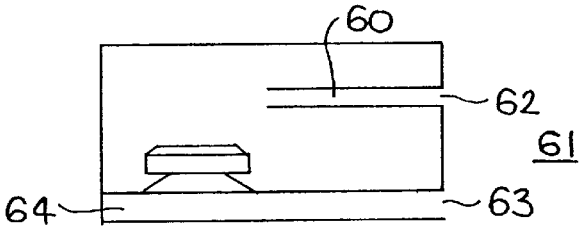
FIG. 6 shows a cross-sectional view of a loudspeaker system according to a further embodiment of the present invention.

FIG. 6 shows a loudspeaker system according to a further embodiment of the present invention. The FIG. 6 embodiment is a modification of the embodiment shown in FIG. 4 in which vent 60 terminates into the exterior space 61 directly. Since the position of open end 62 of vent 60 relative to mouth 63 of duct 64 is different from the embodiment of FIG. 4, the radiation pattern of FIG. 6 embodiment differs from that of FIG. 4. In other respects, the design and operation of the FIG. 6 embodiment is similar to that described with reference to the embodiment of FIG. 4.

Figure 7:
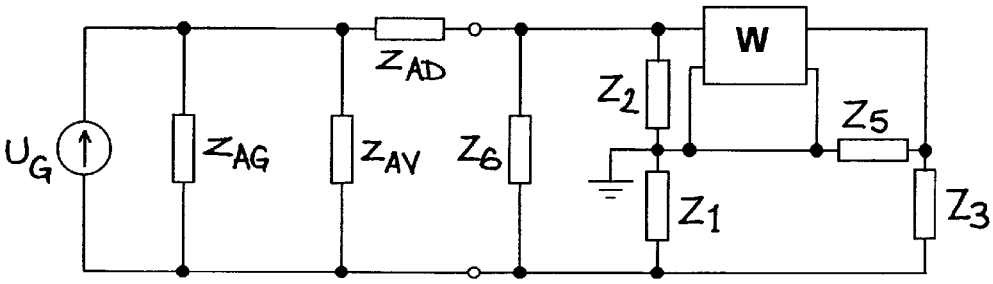
FIG. 7 shows in schematic form, an equivalent acoustical circuit for the loudspeaker system of FIG. 4.

The loudspeaker system of FIG. 4 can be represented by the equivalent acoustical circuit model of FIG. 7 with the acoustic waveguide filter having a characteristic impedance and length shown as a two-port network (W). The equivalent circuit of FIG. 7 can be analysed to show amplitude response, phase response, delay response and other performance criteria. Values of impedance and length can be adjusted from coarsely chosen initial to target values to fine tune the model for optimum performance according to design criteria.

When the desired result is achieved, the model may be realized in an acoustic domain by giving the target values physical filter dimensions. Other factors such as peak volume velocity may be taken into account at this stage. If design criteria dictate or if further improvements to performance are required, a more complex waveguide acoustic filter can be used.

Figure 8:
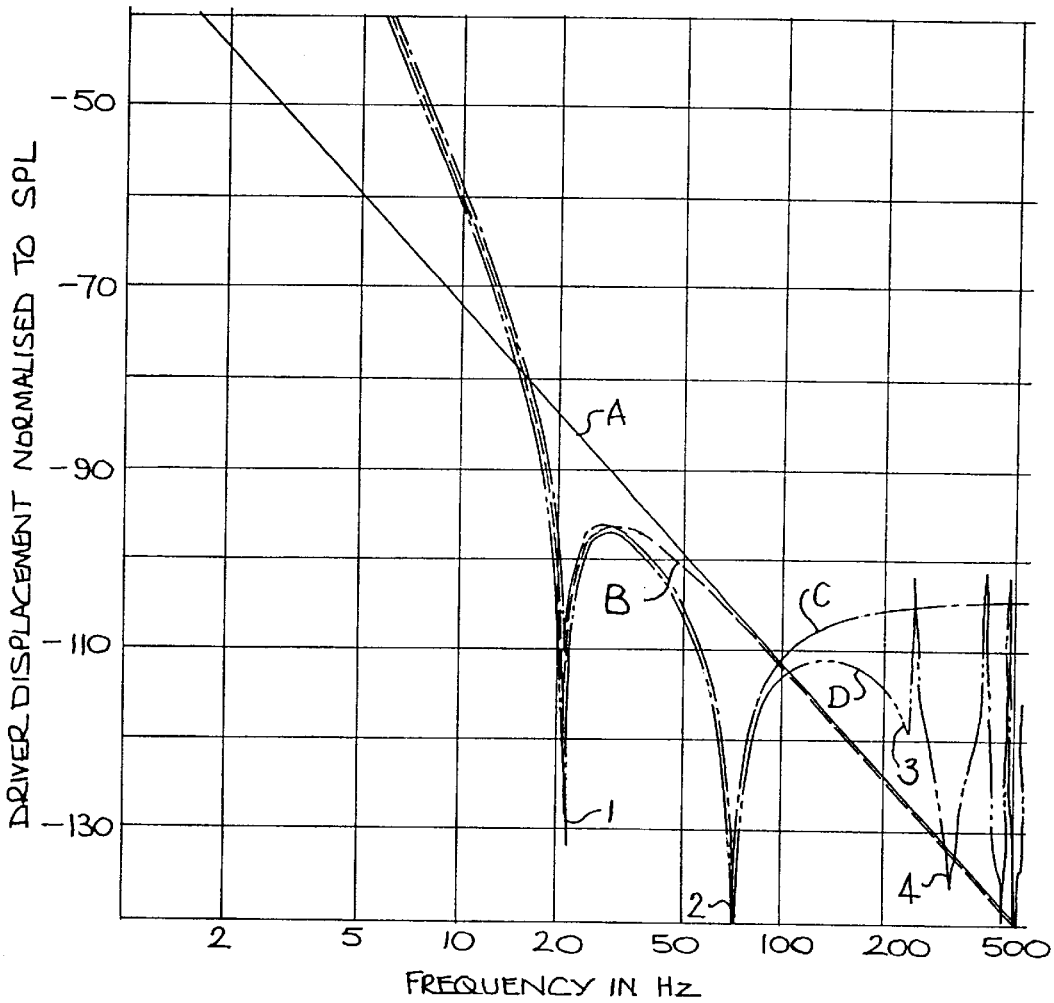
FIG. 8 shows a graphical representation of typical ECCDD values (normalised driver displacement) for the loudspeaker system of FIG. 4.

When the circuit of FIG. 7 is analysed for driver cone displacement with a particular set of values, the result is a curve of cone excursion minima as shown in FIG. 8. In FIG. 8 cone excursion minima 1 and 2 correspond to fundamental resonances of the vented chamber and waveguide filter section, whilst minima 3 and 4 correspond to non-fundamental resonances of the waveguide acoustical filter. The non-fundamental resonances are a consequence of the characteristic impedance and length of the waveguide section.

In FIG. 8 curves A, 8, and C represent the Enclosure Characteristic Curves of Driver Displacement (ECCDD) for prior art sealed, vented and double-vented enclosures respectively, for a given enclosure size. Curve D represents the ECCDD for an enclosure according to the present invention. It is to be appreciated that a lower displacement value indicates less driver displacement for a given level of acoustic output. It may be seen that driver displacement for a given SPL for an enclosure according to the present invention (curve D) is considerably improved over the frequencies of interest when compared to the prior art sealed and vented enclosures (curves A,B). The present invention exceeds the SPL for a given driver displacement for the double-vented (curve C) prior art enclosure over much of the range of the frequencies of interest.

Figure 9:
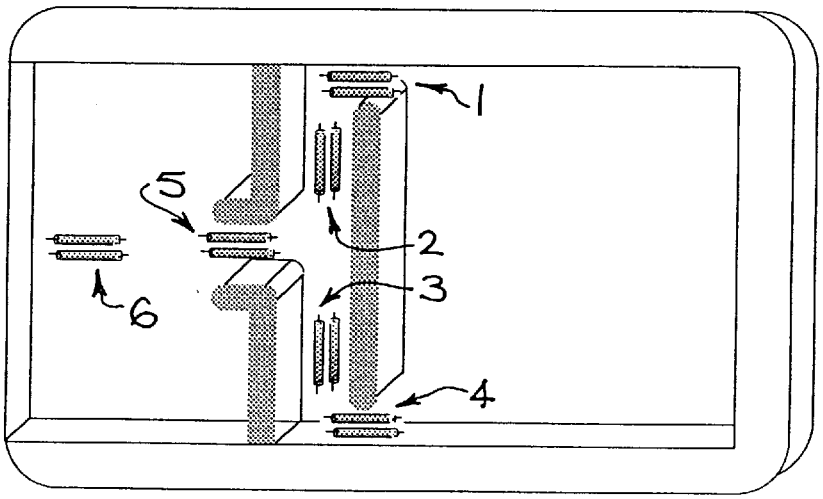
FIG. 9 shows a perspective view of a six section acoustic waveguide filter according to a preferred embodiment of the present invention.
Figure 10:
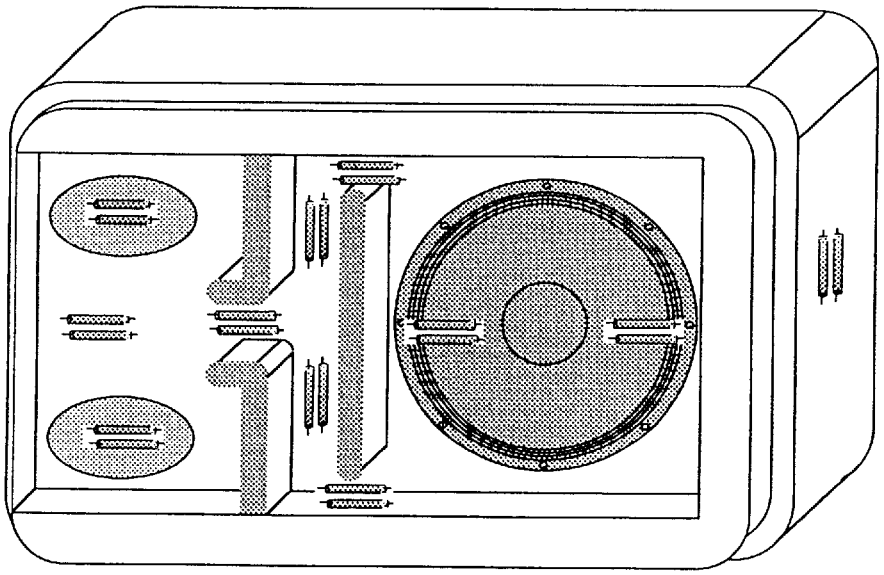
FIG. 10 shows a perspective view of a loudspeaker system including a single vented enclosure and incorporating an acoustic filter as shown in FIG. 9.

In a preferred embodiment, a six section waveguide acoustic filter as shown in FIG. 9 is added to the model, the enclosure then having the configuration shown in FIG. 10. Each section of the filter is labelled 1 to 6 respectively in FIG. 9. To design with best accuracy, the entire enclosure is treated as waveguide sections and an equivalent electrical circuit model is created.

Figure 11:
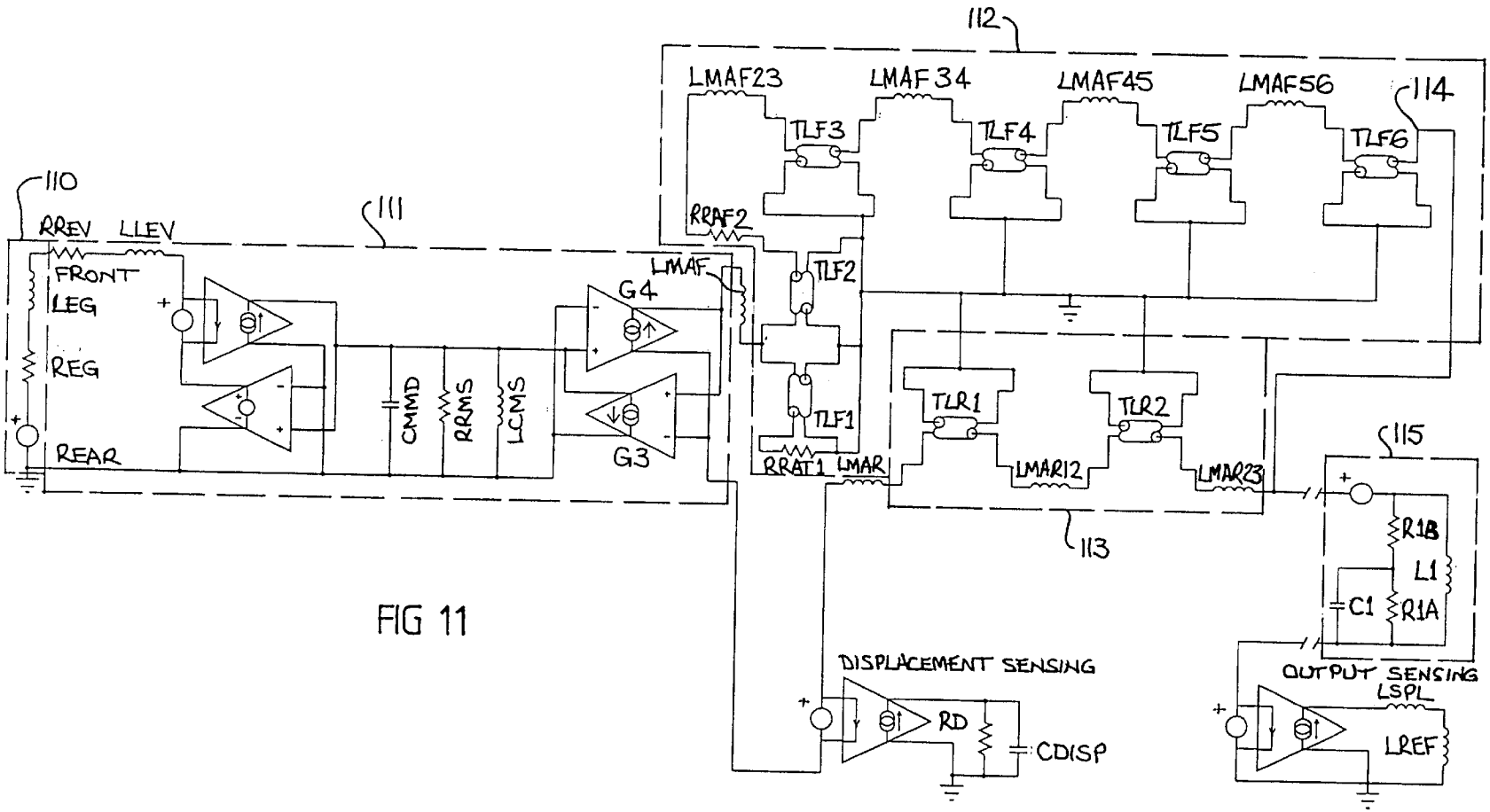
FIG. 11 shows in schematic form, an equivalent electrical circuit for the loudspeaker system shown in FIG. 10.

The equivalent electrical circuit model is shown in FIG. 11. In FIG. 11 block 110 represents the driving source for the loudspeaker system such as an amplifier and block 111 represents the electro-acoustic driver. Since the diaphragm of the driver has front and rear surfaces, inductances LMAF, LMAR represent masses of air associated with the front and rear surfaces respectively of the driver diaphragm. Block 112 represents the six section acoustic waveguide filter of the loudspeaker enclosure. This is modelled with six two-port filter sections TLF1 to TLF6 respectively. Each two-port filter section is defined by values of characteristic impedance and length. Block 113 represents the internal chamber and twin port tubes. The internal chamber is connected to the exterior of the enclosure by distributed masses of gas in the port tubes and is modelled with two two-port filter sections TLR 1 and TLR 2. The port tubes terminate into the exterior space by way of filter section TLF 6 in part, and this is modelled by connection of inductance LMAR 23 to output node 114 of filter section TLF 6. Finally, block 115 represents the exterior air load. Initial values are selected in the model and the response characteristics are determined by analysis followed by fine tuning to optimise performance. Analysis is preferably performed by means of a computer based circuit simulation package such as SPICE. When the desired results are achieved the target values defined in the model are converted to physical filter section dimensions.

Figure 12:
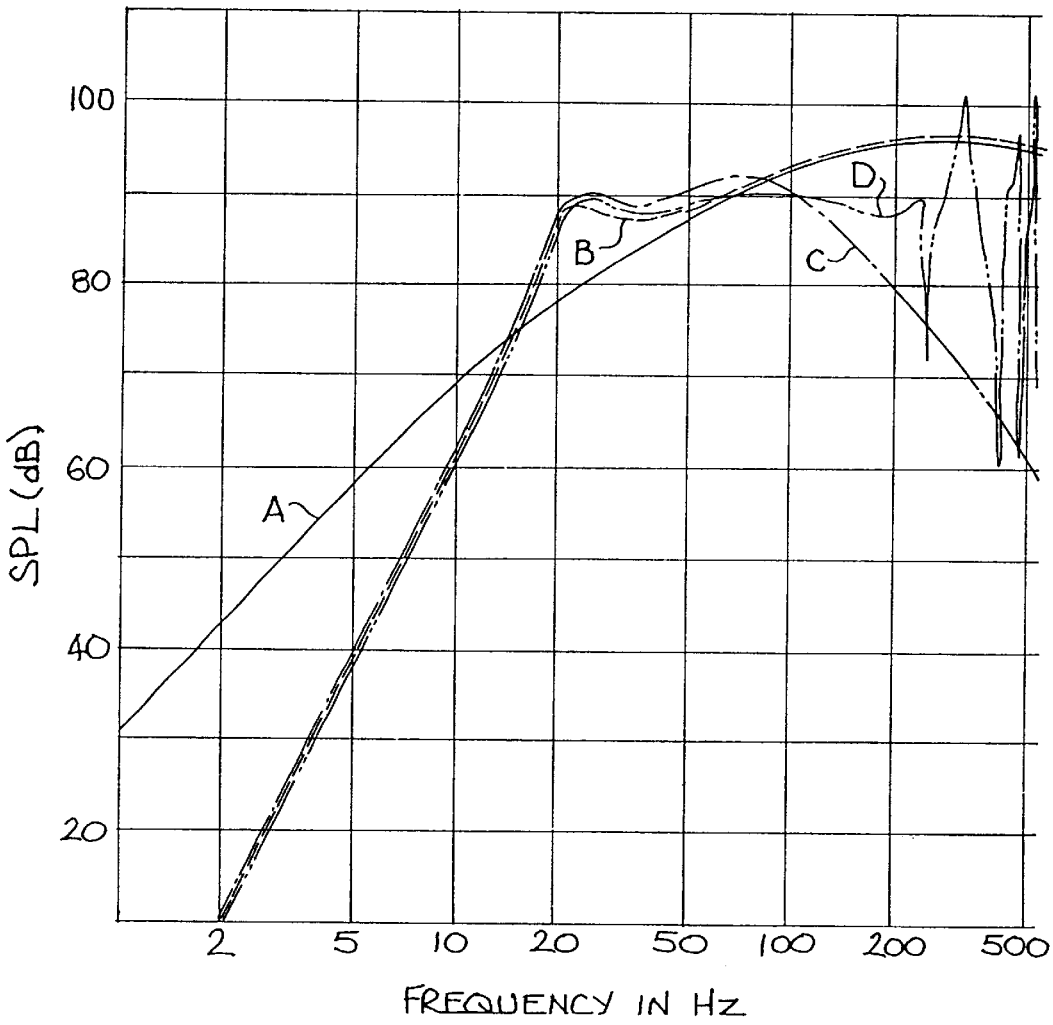
FIG. 12 shows a graphical representation of comparative frequency response for the loudspeaker systems shown in FIGS. 1 to 4.

Referring to FIG. 12, curves A, B and C represent a specific comparative example of the frequency response of prior art sealed, vented and double vented enclosures respectively, with the same electro-acoustic driver being used in a common enclosure size in each case for comparative purposes. Curve D represents a specific example of the frequency response of a loudspeaker system according to the present invention, for the same enclosure size and electro-acoustic driver.

Comparing the frequency responses, it can be seen that the present invention provides improved bass response over that of the sealed and vented configurations (curves A,B). Comparing the frequency response of the present invention with that of the double vented (curve C) prior art, it is apparent that overall bass response is extended at higher bass frequencies whilst the response is more linear with frequency.

Although for the specific comparative example shown in FIG. 12 the output from the prior art displays a peak output which exceeds that of the present invention, inspection of the corresponding ECCDD curve in FIG. 8, reveals that driver displacement is significantly lower for the present invention over this range, facilitating higher acoustic output for a given level of driver displacement and/or induced distortion, than for the prior art.

The acoustic output of the loudspeaker system of the present invention can be adjusted quite flexibly by choice of parameters. For example, the waveguide filter can attenuate or increase output at the expense of linearity of response, or bandwidth can be adjusted for linearity of response at the expense of efficiency.

The present invention provides an improved method of construction of acoustic filters. The invention also provides a substantially reactive acoustic filter employing substantially undamped duct sections resulting from application of the improved method of construction. The invention also provides an improved loudspeaker system resulting from incorporation of the improved filters. The improvements may include minimisation of cone excursion over a relatively wide bandwidth, consequential reduction in distortion, better filtering of harmonics, new degrees of freedom in the alignment of performance objectives, controlled delay response including the option of constant delay, the option of shorter delay than obtainable by prior art modelling, controlled amplitude and phase responses, and elimination of the need for lossy filtering. Consequentially a loudspeaker system according to the present invention may exhibit relatively high efficiency, good transient response, and a structure that is compact and cost effective in comparison to conventional designs.

Finally, it is to be understood that various alterations, modifications and/or additions may be introduced into the constructions and arrangements of parts previously described without departing from the spirit or ambit of the present invention.

APPENDIX

Glossary of Terms

Bl=product of magnetic flux density and voice-coil wire length [Tm]

c=speed of sound in air (343.38 m/s at 20° C.)

$C_A$=acoustical compliance [$m^5/N$]

d=length of waveguide section [m]

j=imaginary unit k=wave-number (=ω/c) [$m^{-1}$]

$M_A$=acoustical mass [$kg/m^4$]

p=sound pressure [Pa=$N/m^2$]

r=mean distance from radiating apertures (diaphragms and ports) to observation point [m]

$S_D$=piston area of driver diaphragm [$m^2$]

$x_D$=piston displacement of driver diaphragm (rms) (=$u_D/(j\omega)$) [m]

$u_D$=piston velocity of driver diaphragm (rms) (m/s)

$Z_o$=characteristic acoustical impedance [$Ns/m^5$]

$\rho_o$=ambient air density (1.2048 $kg/m^3$ at 20° C.)

$\rho_o c$=characteristic impedance of air (413.70 $Ns/m^3$ at 20° C.)

$p_o c^2$=ratio of volume to acoustic compliance of a container of air (=$\gamma P_o$) (142,058 Pa at 20° C.)

γ=ratio of specific heats of air at constant pressure and volume $P_o$=ambient air pressure (101,325 Pa)

τ=time delay of propagation [s]

$x_D$=normalised driver displacement for a given radiated SPL (enclosure characteristic) (=$(x_D/p).(\rho_o S_D/(\Omega r))$) [$s^{-2}$]

ω=angular frequency [rad/s]

Ω=solid angle of radiation (assumed to be 2Ω steradians)

$v_G$=generator voltage from amplifier $Z_{EV}$=blocked voice coil impedance $Z_{AD}=1/j\omega C_{AS}+R_{AS}+j\omega M_{AD}=1/S_D{}^2 Z_{MD}$ (of driver)

$Z_{AF}=(Bl/S_D)^2/Z_{EV}$ (assuming $Z_{EG}$=O of amplifier)

$M_{AP1}$=acoustical mass of rear vent $C_{AB1}$=acoustical compliance of rear chamber $C_{AB3}$=front chamber ahead of acoustic waveguide $\omega_{B1}=1/\sqrt{C_{AB1} M_{AP1}}$ $C_{AS}$=acoustical compliance of driver $R_{AS}$=acoustical resistance of driver $M_{AD}$=acoustical mass of diaphragm $Z_{MD}$=mechanical mobility of diaphragm $U_G$=acoustic referred source input velocity $Z_{AG}$=acoustic referred equivalent source impedance $Z_{AV}$=acoustic referred voice coil impedance=$(Bl)^2/S_D{}^2 Z_{EV}$ $Z_1$,$Z_3$=rear chamber lumped impedance $Z_2$=diaphragm to waveguide lumped acoustic impedance $Z_5$=external terminating airload impedance $Z_6$=driver diaphragm airload impedance

What is claimed is:

1. A method of tuning an acoustic filter of a loudspeaker system to produce a desired response, said method comprising:

providing at least one acoustic waveguide having an inlet and an outlet, for conducting sound waves from said inlet to said outlet;

partitioning said at least one acoustic waveguide into two or more sections, each section being of sufficient length to be definable accurately by a distinct characteristic impedance and length whereby it behaves predominantly as distributed elements, said partitioning including forming at least one impedance discontinuity along the length of the at least one acoustic waveguide;

modelling the loudspeaker system including said acoustic filter such that the acoustic waveguide sections are represented in the model as distributed elements, said modelling including simulating said system including said acoustic filter by means of an equivalent electrical circuit in which acoustical and mechanical elements in said system including said acoustic filter are represented in said circuit as equivalent electrical components;

optimizing said model to produce said desired response, said optimising including adopting initial values for said equivalent electrical components, analysing said circuit to produce a simulated response and comparing the simulated response to the desired response, and if said simulated response is not substantially equal to the desired response, modifying the values of said equivalent electrical components and/or the number of waveguide sections and repeating said optimizing step with the modified values of said equivalent electrical components replacing the initial values; and if said simulated response is substantially equal to said desired response, converting the modified values of said equivalent electrical circuit into acoustical and mechanical elements and incorporating the acoustical and mechanical elements in said system.

2. A method according to claim 1, wherein the or each impedance discontinuity is formed by acoustic waveguide sections having differing cross sectional areas.

3. A method according to claim 1, wherein the or each impedance discontinuity is formed at a junction between two waveguide sections having differing characteristic impedances.

4. A method according to claim 1, wherein the or each impedance discontinuity is formed by connecting the acoustic waveguide sections to form one or more branches.

5. A method according to claim 1, wherein lumped electrical inductors are added to the circuit at the impedance discontinuities to represent discontinuity masses.

6. A method according to claim 1, wherein said at least one acoustic waveguide contains no damping material.

7. A method according to claim 1, wherein said modelling and optimizing is performed via numerical simulation means such as a commercially available computer based simulation package.

8. An acoustic filter for a loudspeaker system having a defined passband, said acoustic filter having an inlet and an outlet and being adapted for conducting sound waves from an electroacoustic transducer in acoustic communication with said inlet, to said outlet, said acoustic filter comprising:

at least one acoustic waveguide partitioned into two or more sections by at least one impedance discontinuity located along its length and requiring no damping material between said inlet and said outlet; and said discontinuity being located such that (i) each section is of sufficient length to be definable accurately by a distinct characteristic impedance and length whereby it behaves predominantly as distributed elements; and (ii) the at least one acoustic waveguide cannot be defined by a single characteristic impedance and length, and is tuned to multiple resonances in the passband.

9. An acoustic filter according to claim 8, wherein the or each impedance discontinuity is formed by acoustic waveguide sections having differing cross sectional areas.

10. An acoustic filter according to claim 8, wherein the or each impedance discontinuity is formed at a junction between two waveguide sections having differing characteristic impedances.

11. An acoustic filter according to claim 8, wherein the or each impedance discontinuity is formed by connecting the acoustic waveguide sections to form one or more branches.

12. An acoustic filter according to claim 8, wherein said at least one acoustic waveguide contains no damping material.

13. An acoustic filter according to claim 8 wherein said at least one acoustic waveguide is tuned by a method according to claim 1.

14. An acoustic filter for a loudspeaker system, said acoustic filter having an inlet and an outlet and being adapted for conducting sound waves from an electroacoustic transducer in acoustic communication with said inlet, to said outlet, said acoustic filter comprising:

at least one acoustic waveguide partitioned into two or more sections by at least one impedance discontinuity located along its length and requiring no damping material between said inlet and said outlet; and said discontinuity being located such that (i) each section is of sufficient length to be definable accurately by a distinct characteristic impedance and length whereby it behaves predominantly as distributed elements; and (ii) the at least one acoustic waveguide cannot be defined by a single characteristic impedance and length, wherein the dimensions of each section of said at least one acoustic waveguide are determined by:

modeling the loudspeaker system including said acoustic filter such that the acoustic waveguide sections are represented in the model as distributed elements, said modeling including simulating said system including said acoustic filter by means of an equivalent electrical circuit in which acoustical and mechanical elements in said system including said acoustic filter are represented in said circuit as equivalent electrical components;

optimizing said model to produce said desired response, said optimizing including adopting initial values for said equivalent electrical components, analyzing said circuit to produce a simulated response and comparing the simulated response to the desired response, and if said simulated response is not substantially equal to the desired response, modifying the values of said equivalent electrical components and/or the number of waveguide sections and repeating said optimizing step with the modified values of said equivalent electrical components replacing the initial values; and if said simulated response is substantially equal to said desired response, converting the modified values of said equivalent electrical circuit into acoustical and mechanical elements and incorporating the acoustical and mechanical elements in said system.

* * * * *